US009252544B2

(12) United States Patent
Yang

(10) Patent No.: US 9,252,544 B2
(45) Date of Patent: Feb. 2, 2016

(54) PLUGGING AND UNPLUGGING MODULE CASE

(71) Applicant: ALL BEST PRECISION TECHNOLOGY CO., LTD., Taoyuan County (TW)

(72) Inventor: Haven Yang, New Taipei (TW)

(73) Assignee: ALL BEST PRECISION TECHNOLOGY CO., LTD., Taoyuan County (TW)

( * ) Notice: Subject to any disclaimer, the term of this patent is extended or adjusted under 35 U.S.C. 154(b) by 83 days.

(21) Appl. No.: 14/261,261

(22) Filed: Apr. 24, 2014

(65) Prior Publication Data

US 2015/0311644 A1 Oct. 29, 2015

(51) Int. Cl.
*H01R 13/648* (2006.01)
*H01R 13/74* (2006.01)
*H01R 13/6593* (2011.01)

(52) U.S. Cl.
CPC ..... *H01R 13/745* (2013.01); *H01R 13/6593* (2013.01)

(58) Field of Classification Search
CPC .... H01R 13/74; H01R 13/741; H01R 13/745; H01R 13/6582; H01R 13/6583
USPC ..... 439/607.2, 607.21, 607.28, 939
See application file for complete search history.

(56) References Cited

U.S. PATENT DOCUMENTS

| | | | | |
|---|---|---|---|---|
| 7,869,224 | B1 * | 1/2011 | Yang | G02B 6/4284 174/350 |
| 8,053,667 | B2 * | 11/2011 | Chen | H05K 9/0058 174/50 |
| 8,500,490 | B2 * | 8/2013 | Tsou | H01R 23/6873 439/607.55 |
| 8,808,030 | B2 * | 8/2014 | Gao | H01R 13/6271 439/607.4 |
| 8,894,438 | B2 * | 11/2014 | Schmitt | H01R 24/76 439/540.1 |

* cited by examiner

*Primary Examiner* — Khiem Nguyen
(74) *Attorney, Agent, or Firm* — WPAT, P.C.; Anthony King

(57) ABSTRACT

A plugging and unplugging module case includes a body and a positioning element. The body has a plugging and unplugging opening. The positioning element has a positioning elastic body and a second engaging unit. The positioning element is disposed outside the body. The second engaging unit is a second engaging post for engaging with the first engaging hole. The body is of lower hardness than the positioning element. Hence, the positioning element quickly engages with the body, whereas the positioning elastic body is quickly positioned at a positioning hole so as to enhance the efficiency of the assembly of the plugging and unplugging module.

11 Claims, 4 Drawing Sheets

PLUGGING AND UNPLUGGING MODULE CASE

FIELD OF THE INVENTION

The present invention relates to plugging and unplugging module cases, and more particularly, to a plugging and unplugging module case equipped with a positioning element which quickly engages with a body, equipped with a positioning elastic body which is quickly positioned at a positioning hole, and adapted to enhance assembly efficiency.

BACKGROUND OF THE INVENTION

Rarely does transmission of data between electronic apparatuses nowadays not require a plugging and unplugging module. However, in general, a conventional positioning element of a conventional plugging and unplugging module case of a conventional plugging and unplugging module is difficult to be mounted on a body thereof. After being mounted on the body, the conventional positioning element is difficult to be positioned at a device to be installed. Accordingly, it is important to invent a plugging and unplugging module case with a positioning element which quickly engages with the body and positioning elastic bodies which can be quickly positioned at a positioning hole so as to enhance the efficiency of the assembly of the plugging and unplugging module.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a plugging and unplugging module case as disclosed in the present invention to ensure that its positioning element can quickly engage with a body and its positioning elastic bodies can be quickly positioned at a positioning hole so as to enhance the efficiency of the assembly of a plugging and unplugging module.

In order to achieve the above and other objectives, the present invention provides a plugging and unplugging module case, comprising: a body having at least a plugging and unplugging opening; and a positioning element having at least a positioning elastic body and at least a second engaging unit. The positioning element is disposed outside the body. The second engaging unit is a second engaging post for engaging with the body. The body is of lower hardness than the positioning element.

As regards the plugging and unplugging module case, the body has at least a first engaging unit. The first engaging unit is a first engaging hole. The second engaging post engages with the first engaging hole.

As regards the plugging and unplugging module case, the first engaging unit is disposed at a periphery of the plugging and unplugging opening, and the positioning elastic body is positioned proximate to the second engaging unit.

As regards the plugging and unplugging module case, the first engaging post is a hollow-cored post, or the second engaging post is a hollow-cored post.

As regards the plugging and unplugging module case, the positioning elastic body is a positioning leaf spring. The positioning leaf spring tilts toward the rear of the plugging and unplugging opening.

As regards the plugging and unplugging module case, the body is externally provided with at least an L-shaped connecting element. The positioning element has at least a positioning notch. The positioning elastic body is disposed between the second engaging unit and the positioning notch. The second engaging unit is positioned proximate to the plugging and unplugging opening. The L-shaped connecting element is inserted into the positioning notch.

As regards the plugging and unplugging module case, the positioning element has a U-shaped plate and a flat plate. The U-shaped plate and the flat plate are disposed outside the body. The positioning elastic bodies and the second engaging unit are disposed at the U-shaped plate and the flat plate.

Hence, a plugging and unplugging module case of the present invention has a positioning element which quickly engages with a body and a positioning elastic body which is quickly positioned at a positioning hole so as to enhance the efficiency of the assembly of the plugging and unplugging module.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
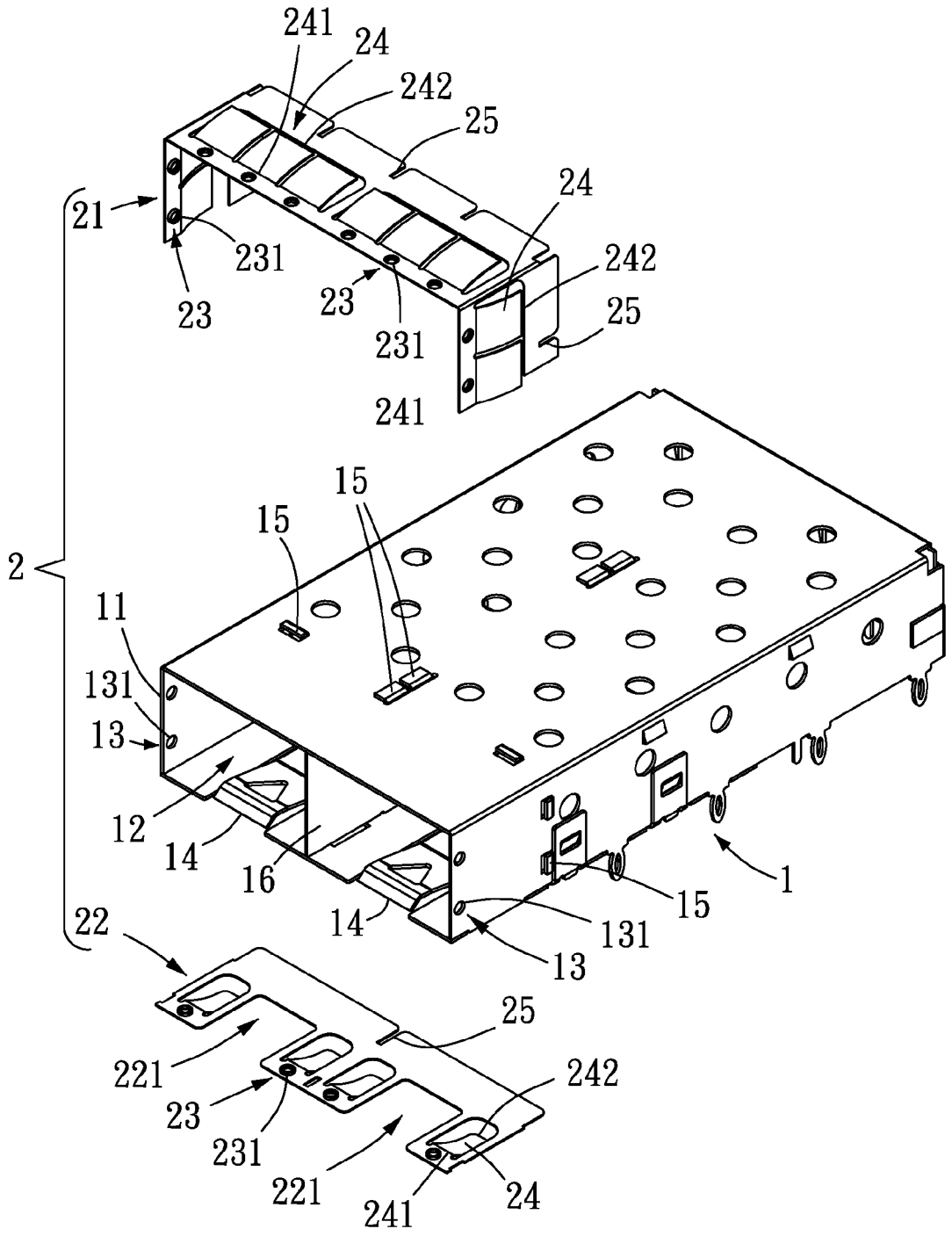
FIG. 1 is a schematic exploded view of a plugging and unplugging module case according to an embodiment of the present invention.
Figure 2:
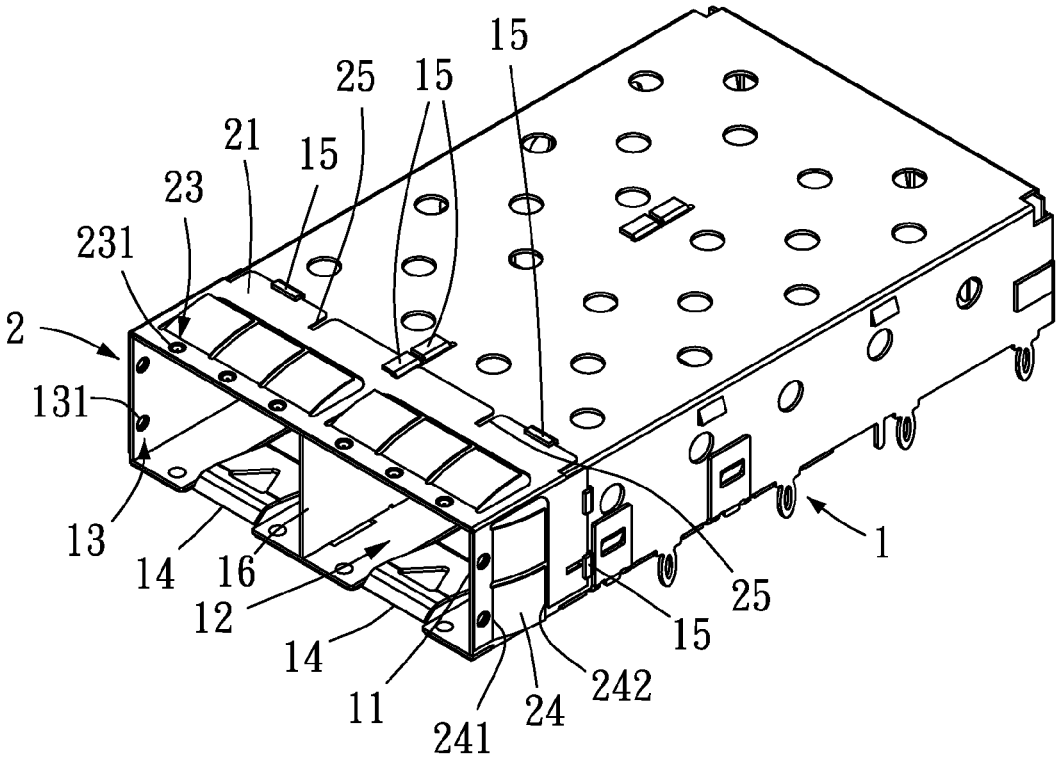
FIG. 2 is a schematic view of the plugging and unplugging module case assembled according to the embodiment of the present invention.

FIG. 1 and FIG. 2 are a schematic exploded view and a schematic view of a plugging and unplugging module case according to an embodiment of the present invention, respectively. As shown in the diagrams, the present invention provides a plugging and unplugging module case which comprises a body 1 and a positioning element 2. The body 1 has at least a plugging and unplugging opening 11. The plugging and unplugging opening 11 is rectangular, such that a plugging and unplugging device (not shown) can pass through the plugging and unplugging opening 11 and then is positioned at a plugging and unplugging channel 12 of the body 1. The positioning element 2 has at least a positioning elastic body 24 and at least a second engaging unit 23. The positioning element 2 is disposed outside the body 1. The second engaging unit 23 is a second engaging post 231 for engaging with the body 1. The cross section of the second engaging post 231 is round, square, or is of any appropriate geometrical shape. The body 1 is of lower hardness than the positioning element 2. With the positioning element 2 being of a hardness higher than the body 1, as soon as the second engaging post 231 of the positioning element 2 gets engaged with the body 1, the second engaging post 231 is inserted into the wall of the body 1 such that the wall of the body 1 sags, deforms, and encloses the second engaging post 231, thereby causing the second engaging post 231 of the positioning element 2 to engage with the wall of the body 1.

Figure 3:
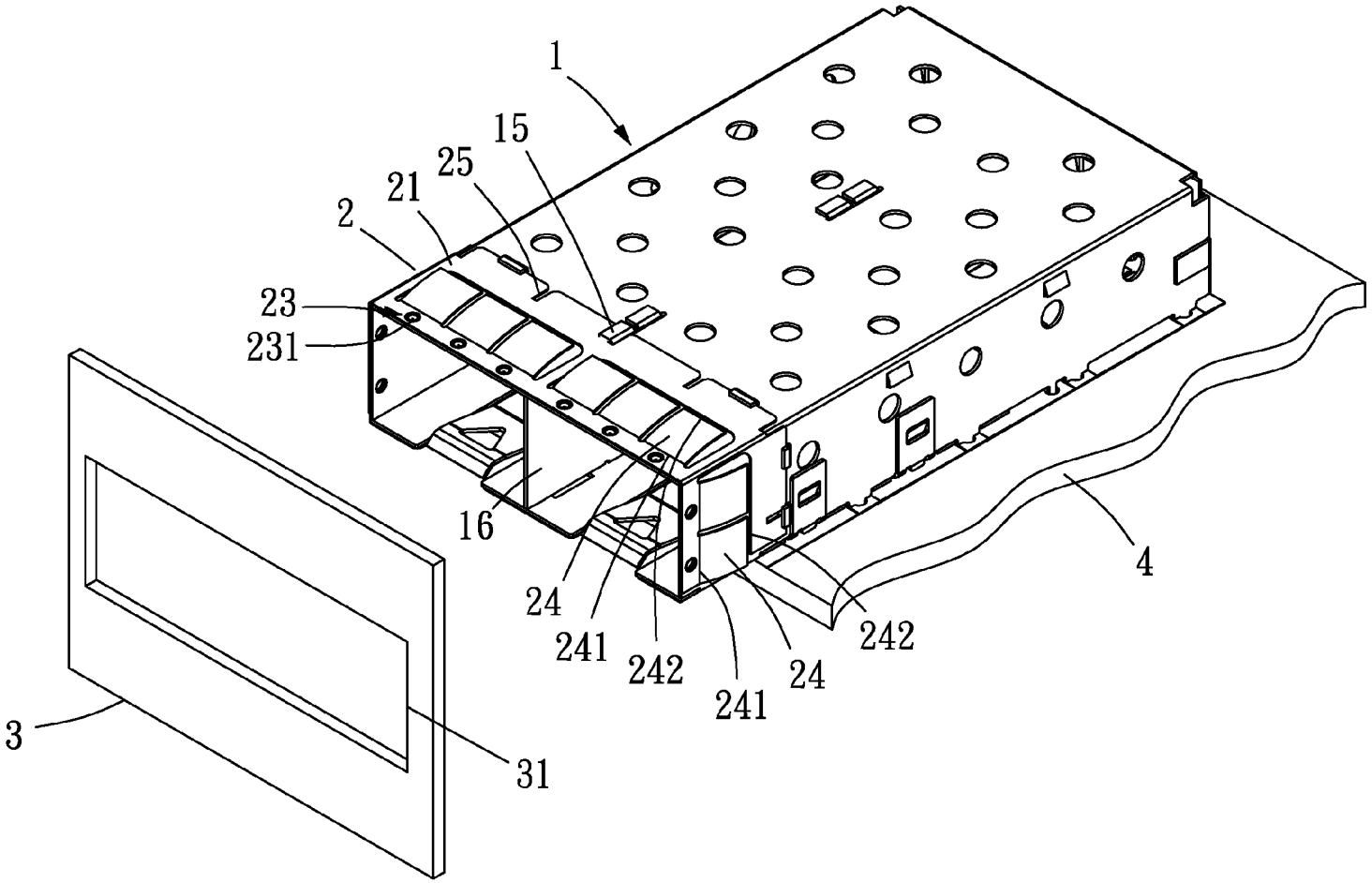
FIG. 3 is a schematic view of the application of the plugging and unplugging module case according to the embodiment of the present invention.
Figure 4:
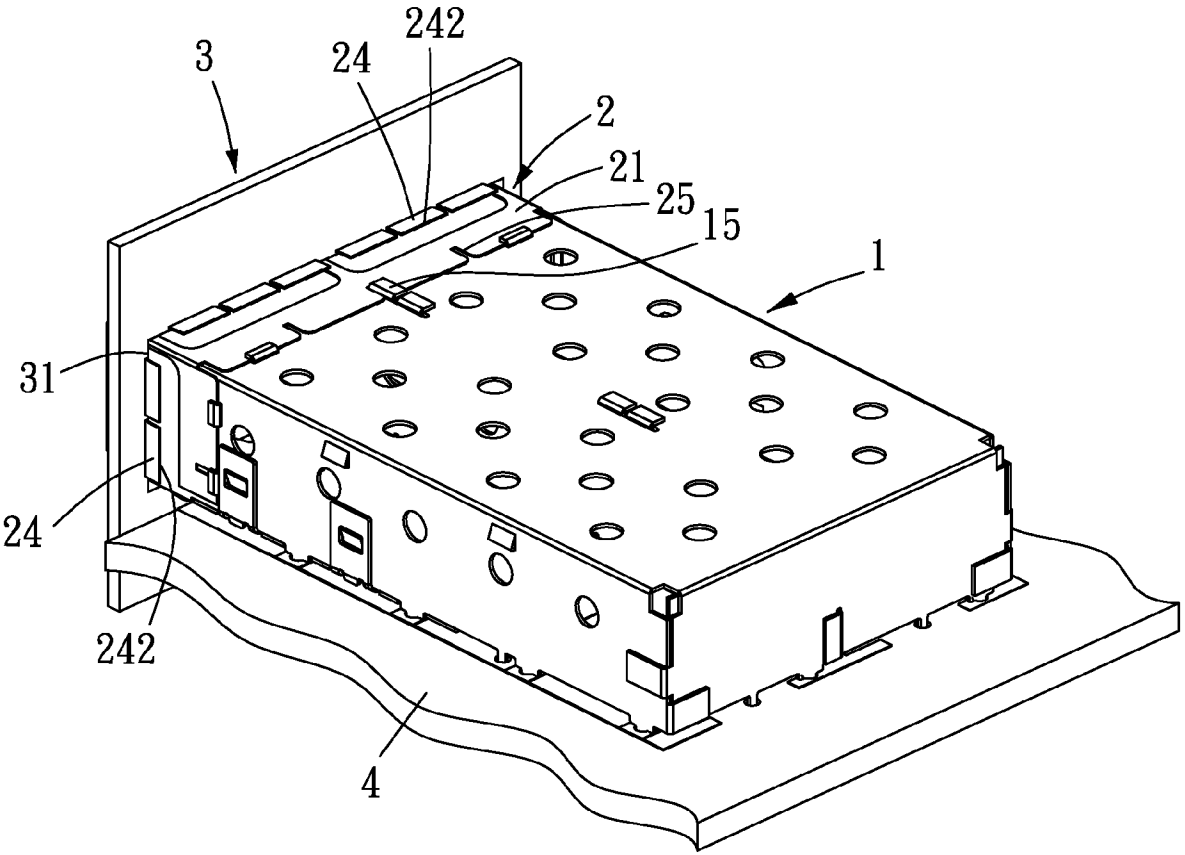
FIG. 4 is another schematic view of the application of the plugging and unplugging module case according to the embodiment of the present invention.

FIG. 3 and FIG. 4 are two schematic views of the application of the plugging and unplugging module case according to the embodiment of the present invention. As shown in the diagrams, the plugging and unplugging module case of the present invention is fixed to a fixing structure 4. To allow the plugging and unplugging module case to be positioned at a positioning hole 31 of an external structure 3, the plugging and unplugging opening 11 of the plugging and unplugging module case must face the positioning hole 31. The positioning hole 31 corresponds in shape to the plugging and unplugging openings 11 and is rectangular. The positioning hole 31 is slightly larger than the plugging and unplugging openings 11. Afterward, the plugging and unplugging module case is inserted into the positioning hole 31. During the process in which the plugging and unplugging module case is inserted into the positioning hole 31, the inner rim of the positioning hole 31 abuts against the positioning elastic bodies 24 and thereby presses the positioning elastic bodies 24 downward until the plugging and unplugging module case is inserted into the positioning elastic bodies 24. At this point in time, with the positioning elastic bodies 24 being pressed downward, the positioning elastic bodies 24 exerts a reaction force on the inner rim of the positioning hole 31. The reaction force brings about a friction between the inner rim of the positioning hole 31 and the positioning elastic bodies 24, and in consequence the plugging and unplugging module case can be positioned at the positioning hole 31. To remove the plugging and unplugging module case from the positioning hole 31 of the external structure 3, a rearward external force is applied to the body 1 to oppose the friction.

As described above, the second engaging unit 23 and the positioning element 2, which can be quickly engaged with the body 1, enhance assembly efficiency. Furthermore, due to the positioning elastic body 24, the plugging and unplugging module case can be quickly positioned at the positioning hole 31 of the external structure 3 (or quickly removed from the positioning hole 31 of the external structure 3) so as to enhance assembly efficiency.

Referring to FIG. 1 and FIG. 2, as regards the plugging and unplugging module case, the body 1 has at least a first engaging unit 13. The first engaging unit 13 is a first engaging hole 131. The second engaging post 231 can be engaged with the first engaging hole 131. The cross section of the second engaging post 231 corresponds in shape to the first engaging hole 131 and is round, square, or is of any appropriate geometrical shape. Furthermore, the cross section of the second engaging post 231 is slightly larger than the first engaging hole 131 such that the second engaging post 231 can be inserted into the first engaging hole 131 and thus engaged with the first engaging hole 131. With the positioning element 2 being of a hardness higher than the body 1, as soon as the second engaging post 231 of the positioning element 2 is inserted into the first engaging hole 131 of the body 1, the first engaging hole 131 is slightly deformed and enlarged so as to engage with the second engaging post 231.

Referring to FIG. 1 through FIG. 4, as regards the plugging and unplugging module case, the first engaging unit 13 is disposed at the periphery of the plugging and unplugging opening 11, for example, above, below, to the left of, to the right of, or in the vicinity of the plugging and unplugging opening 11. If the plugging and unplugging openings 11 are provided in the plural and are connected to each other, and the first engaging units 13 are provided in the plural, the first engaging units 13 will be disposed at the periphery of the plugging and unplugging openings 11 rather than disposed at a spacer 16 (as shown in FIG. 1). The positioning elastic body 24 is positioned proximate to the second engaging unit 23, and the second engaging unit 23 is provided in the plural so as to match the quantity of the first engaging units 13. Furthermore, the second engaging unit 23 is of a larger quantity than the first engaging unit 13. Any extra said second engaging units 23 will be directly engaged with the wall of the body 1. In the situation where the positioning elastic body 24 is provided in the plural, the positioning elastic bodies 24 not only surround the plugging and unplugging openings 11 and are arranged in a rectangular pattern but are also parallel to the plugging and unplugging opening 11. Hence, the positioning hole 31 of the external structure 3, at which the plugging and unplugging module case is positioned, is positioned proximate to the plugging and unplugging openings 11 so as to prevent the plugging and unplugging module case from reaching an overly great depth of the positioning hole 31.

Referring to FIG. 1, as regards the plugging and unplugging module case, the second engaging post 231 is a hollow-cored post. Hence, the second engaging post 231 is directly formed by piercing the positioning element 2 or formed by means of a die, wherein the second engaging post 231 and the positioning element 2 are integrally formed as a unitary structure. Moreover, since the second engaging post 231 is a hollow-cored post, as soon as the second engaging post 231 of the positioning element 2 gets engaged with the wall of the body 1, the second engaging post 231 is inserted into the wall of the body 1 such that the body 1 encloses the inner wall and the outer wall of the second engaging post 231; hence, the second engaging post 231 of the positioning element 2 is firmly engaged with the wall of the body 1.

Referring to FIG. 1 through FIG. 4, as regards the plugging and unplugging module case, the positioning elastic body 24 is a positioning leaf spring. The positioning elastic body 24 is rectangular or is of any appropriate geometrical shape. The positioning elastic body 24 has a connecting end 241 connected to the positioning element 2 and has a free end 242 positioned distal to the plugging and unplugging opening 11 such that the positioning elastic body 24 tilts toward the rear of the plugging and unplugging opening 11. The positioning elastic body 24 is formed by punching the positioning element 2. The positioning elastic bodies 24 tilts toward the rear of the plugging and unplugging opening 11. Hence, during the process in which the plugging and unplugging module case is inserted into the positioning hole 31 of the external structure 3, the positioning elastic bodies 24 are not stopped outside the positioning hole 31. Furthermore, during the process in which the plugging and unplugging module case is inserted into the positioning hole 31 of the external structure 3, the inner rim of the positioning hole 31 abuts against the oblique surfaces of the positioning elastic bodies 24 and thus presses the positioning elastic bodies 24 downward until the plugging and unplugging module case reaches the middle or rear of the positioning elastic bodies 24. At this point in time, since the positioning elastic bodies 24 are pressed downward, the positioning elastic bodies 24 exert a reaction force upon the inner rim of the positioning hole 31, wherein the reaction force brings about a friction between the inner rim of the positioning hole 31 and the positioning elastic bodies 24, and in consequence the plugging and unplugging module case is positioned at the positioning hole 31.

Referring to FIG. 1 and FIG. 2, as regards the plugging and unplugging module case, the body 1 is externally provided with at least an L-shaped connecting element 15, and the positioning element 2 has at least a positioning notch 25. The positioning elastic body 24 is disposed between the second engaging unit 23 and the positioning notch 25. The second engaging unit 23 is positioned proximate to the plugging and unplugging opening 11, and the L-shaped connecting element 15 can be inserted into the positioning notch 25. Hence, the positioning element 2 is characterized in that: the second engaging unit 23 engages with the body 1; and the L-shaped connecting element 15 can be inserted into the positioning notch 25 to enhance the stability of assembly.

Referring to FIG. 1 and FIG. 2, as regards the plugging and unplugging module case, the positioning element 2 has a U-shaped plate 21 and a flat plate 22. The U-shaped plate 21 and the flat plate 22 are disposed outside the body 1 and surround the plugging and unplugging openings 11. The positioning elastic bodies 24 and the second engaging unit 23 are disposed at the U-shaped plate 21 and the flat plate 22. Furthermore, the positioning notch 25 is disposed at the U-shaped plate 21 and the flat plate 22. Hence, the positioning element 2 is vertically engaged with the body 1 to enhance the ease of assembly. Furthermore, the flat plate 22 has at least a slot 221 whereby interference with a positioning leaf spring 14 of the body 1 is precluded.

Referring to FIG. 3, as regards the plugging and unplugging module case, the positioning element 2 is of a hardness higher than the body 1, such that the positioning element 2 has high structurally strength to engage with the body 1 and is positioned at the positioning hole 31 of the external structure 3. For instance, the positioning element 2 is made of white iron, and the body 1 is made of brass.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A plugging and unplugging module case, comprising:

a body having at least a plugging and unplugging opening; and a positioning element having at least a positioning elastic body and at least a second engaging unit, the positioning element being disposed outside the body, the second engaging unit being a second engaging post for engaging with the body, the second engaging post is a hollow-cored post, and the body being of lower hardness than the positioning element.

2. The plugging and unplugging module case of claim 1, the body has at least a first engaging unit, the first engaging unit being a first engaging hole, and the second engaging post engages with the first engaging hole.

3. The plugging and unplugging module case of claim 2, the first engaging unit is disposed at a periphery of the plugging and unplugging opening, and the positioning elastic body is positioned proximate to the second engaging unit.

4. The plugging and unplugging module case of claim 1, wherein the positioning elastic body is a positioning leaf spring, and the positioning leaf spring tilts toward a rear of the plugging and unplugging opening.

5. The plugging and unplugging module case of claim 1, wherein the body is externally provided with at least an L-shaped connecting element, the positioning element has at least a positioning notch, the positioning elastic body is disposed between the second engaging unit and the positioning notch, the second engaging unit is positioned proximate to the plugging and unplugging opening, and the L-shaped connecting element is inserted into the positioning notch.

6. The plugging and unplugging module case of claim 1, wherein the positioning element has a U-shaped plate and a flat plate which are disposed outside the body, wherein the positioning elastic bodies and the second engaging unit are disposed at the U-shaped plate and the flat plate.

7. A plugging and unplugging module case, comprising:

a body having at least a plugging and unplugging opening; and a positioning element having at least a positioning elastic body and at least a second engaging unit, the positioning element being disposed outside the body, the second engaging unit being a second engaging post for engaging with the body, and the body being of lower hardness than the positioning element, wherein the body is externally provided with at least an L-shaped connecting element, the positioning element has at least a positioning notch, the positioning elastic body is disposed between the second engaging unit and the positioning notch, the second engaging unit is positioned proximate to the plugging and unplugging opening, and the L-shaped connecting element is inserted into the positioning notch.

8. The plugging and unplugging module case of claim 7, wherein the body has at least a first engaging unit, the first engaging unit being a first engaging hole, and the second engaging post engages with the first engaging hole.

9. The plugging and unplugging module case of claim 8, wherein the first engaging unit is disposed at a periphery of the plugging and unplugging opening, and the positioning elastic body is positioned proximate to the second engaging unit.

10. The plugging and unplugging module case of claim 7, wherein the positioning elastic body is a positioning leaf spring, and the positioning leaf spring tilts toward a rear of the plugging and unplugging opening.

11. The plugging and unplugging module case of claim 7, wherein the positioning element has a U-shaped plate and a flat plate which are disposed outside the body, wherein the positioning elastic bodies and the second engaging unit are disposed at the U-shaped plate and the flat plate.

* * * * *